US008052012B2

(12) United States Patent
Kelly et al.

(10) Patent No.: US 8,052,012 B2
(45) Date of Patent: Nov. 8, 2011

(54) REGULATED FLUID DISPENSING DEVICE AND METHOD OF DISPENSING A CARBONATED BEVERAGE

(75) Inventors: Jason Morgan Kelly, Arvada, CO (US); Vong Hoss, New Territories (HK); Gregory Clegg Spooner, New Territories (HK)

(73) Assignee: MillerCoors, LLC, Golden, CO (US)

( * ) Notice: Subject to any disclaimer, the term of this patent is extended or adjusted under 35 U.S.C. 154(b) by 560 days.

(21) Appl. No.: 12/255,230

(22) Filed: Oct. 21, 2008

(65) Prior Publication Data

US 2009/0283554 A1 Nov. 19, 2009

Related U.S. Application Data

(63) Continuation-in-part of application No. 12/123,262, filed on May 19, 2008.

(51) Int. Cl.
*B65D 83/00* (2006.01)

(52) U.S. Cl. ..... 222/399; 222/505

(58) Field of Classification Search ..... 222/399, 222/153.12–152.14, 396–398, 505, 206, 222/212, 213, 464.1, 564; 137/497, 505.36
See application file for complete search history.

(56) References Cited

U.S. PATENT DOCUMENTS

| | | | | |
|---|---|---|---|---|
| 1,832,587 | A | 11/1931 | Schneible | |
| 2,549,207 | A * | 4/1951 | Kestenbaum | 222/131 |
| 2,569,378 | A | 9/1951 | Hood | |
| 3,160,326 | A | 12/1964 | Sturdevant et al. | |
| 3,246,825 | A | 4/1966 | Zastrow | |
| 3,349,986 | A | 10/1967 | Chapman et al. | |
| 3,478,929 | A | 11/1969 | Cornelius | |
| 3,558,010 | A * | 1/1971 | Zenger et al. | 222/5 |
| 3,756,471 | A | 9/1973 | Wissman | |
| 4,186,848 | A * | 2/1980 | Walter | 222/23 |
| 4,265,374 | A | 5/1981 | Sebalos | |
| 4,482,509 | A | 11/1984 | Iannelli | |
| 4,610,888 | A | 9/1986 | Teng et al. | |
| 4,696,840 | A | 9/1987 | McCullough et al. | |

(Continued)

FOREIGN PATENT DOCUMENTS

CA 2355267 6/2000

(Continued)

OTHER PUBLICATIONS

U.S. Appl. No. 12/389,164, filed Feb. 19, 2009, Kelly et al.

(Continued)

*Primary Examiner* — Lien Ngo
(74) *Attorney, Agent, or Firm* — Sheridan Ross, P.C.

(57) ABSTRACT

A device and method are provided for dispensing a beverage from a pressurized container. The dispensing device includes an integral source of compressed gas for maintaining the beverage within the container at a desired pressurized state. The dispensing device also includes a regulator for controlling the flow of gas from the compressed gas source to the interior of the container, as well as a pressure relief mechanism that accounts for potential over pressurization of the container. The beverage is selectively dispensed by actuation of a tap handle. Delivery is achieved through the device by a resilient delivery tube, and the delivery tube is either pinched closed or allowed to decompress by the actuation of the tap handle. In another embodiment, a check valve is used to control flow of the beverage in which the tap handle activates a transfer rod to seat and unseat a check element.

3 Claims, 17 Drawing Sheets

U.S. PATENT DOCUMENTS

| | | | | |
|---|---|---|---|---|
| 4,735,348 | A | 4/1988 | Santoiemmo et al. | |
| 4,793,515 | A | 12/1988 | Shannon et al. | |
| 4,955,512 | A | 9/1990 | Sharples | |
| 4,979,641 | A | 12/1990 | Turner | |
| 4,995,945 | A | 2/1991 | Craig | |
| 5,022,565 | A * | 6/1991 | Sturman et al. | 222/396 |
| D325,344 | S | 4/1992 | Scholle | |
| 5,106,015 | A | 4/1992 | Vlasaty et al. | |
| 5,111,970 | A | 5/1992 | Rutter et al. | |
| 5,115,626 | A | 5/1992 | Rutter et al. | |
| 5,115,841 | A | 5/1992 | Horino et al. | |
| 5,139,708 | A | 8/1992 | Scott | |
| 5,147,071 | A | 9/1992 | Rutter et al. | |
| 5,203,470 | A | 4/1993 | Brown | |
| 5,329,975 | A | 7/1994 | Heitel | |
| 5,395,012 | A | 3/1995 | Grill | |
| 5,396,934 | A | 3/1995 | Moench | |
| 5,443,186 | A | 8/1995 | Grill | |
| 5,458,165 | A | 10/1995 | Liebmann, Jr. | |
| 5,487,850 | A | 1/1996 | Vanderploeg | |
| 5,551,600 | A | 9/1996 | Sasaki et al. | |
| 5,565,149 | A | 10/1996 | Page et al. | |
| 5,750,216 | A | 5/1998 | Horino et al. | |
| 5,788,121 | A | 8/1998 | Sasaki et al. | |
| 5,788,840 | A | 8/1998 | Lee et al. | |
| 5,826,752 | A | 10/1998 | Latimer | |
| 5,925,563 | A | 7/1999 | Redford | |
| 5,979,713 | A | 11/1999 | Grill | |
| 6,036,054 | A | 3/2000 | Grill | |
| 6,045,036 | A | 4/2000 | Ring | |
| 6,116,467 | A | 9/2000 | Petriekis et al. | |
| 6,138,995 | A | 10/2000 | Page | |
| 6,321,948 | B1 | 11/2001 | Bellon et al. | |
| 6,355,292 | B1 | 3/2002 | Cheng et al. | |
| 6,595,391 | B1 | 7/2003 | Anderson | |
| 6,609,636 | B1 | 8/2003 | Petriekis et al. | |
| 6,612,545 | B1 | 9/2003 | Rutter et al. | |
| 6,637,623 | B2 | 10/2003 | Muise et al. | |
| 6,702,337 | B2 | 3/2004 | Rutter et al. | |
| 6,802,341 | B1 | 10/2004 | Johnson et al. | |
| 6,827,237 | B2 | 12/2004 | Yorn et al. | |
| 6,880,797 | B2 | 4/2005 | Yui | |
| 6,893,000 | B2 | 5/2005 | Rutter et al. | |
| 6,942,123 | B2 | 9/2005 | Wertenberger | |
| 6,971,548 | B2 | 12/2005 | Smith | |
| 7,032,781 | B2 | 4/2006 | Van Der Klaauw et al. | |
| 7,137,538 | B2 | 11/2006 | Wright | |
| 7,150,377 | B2 | 12/2006 | Cook et al. | |
| 7,178,699 | B2 * | 2/2007 | Spray et al. | 222/212 |
| 7,188,751 | B2 * | 3/2007 | Van Der Klaauw et al. | 222/146.6 |
| 7,389,909 | B2 | 6/2008 | Crosland et al. | |
| D582,722 | S | 12/2008 | Pena | |
| 7,721,921 | B2 * | 5/2010 | Ramusch et al. | 222/505 |
| 7,806,299 | B2 | 10/2010 | Wauters et al. | |
| 2003/0024950 | A1 | 2/2003 | Yoneyama et al. | |
| 2006/0071021 | A1 | 4/2006 | Steeves et al. | |
| 2006/0097005 | A1 | 5/2006 | Hill et al. | |
| 2006/0118574 | A1 | 6/2006 | Anderson et al. | |
| 2006/0169725 | A1 | 8/2006 | Grill | |
| 2006/0243783 | A1 | 11/2006 | Spivey et al. | |
| 2009/0242044 | A1 | 10/2009 | Kranz et al. | |
| 2009/0242063 | A1 | 10/2009 | Kranz et al. | |

FOREIGN PATENT DOCUMENTS

| | | |
|---|---|---|
| CA | 2596916 | 8/2006 |
| EP | 0132340 | 1/1985 |
| EP | 0276994 | 8/1988 |
| EP | 0683224 | 11/1995 |
| EP | 0732142 | 9/1996 |
| EP | 1094027 | 4/2001 |
| JP | 2019276 | 1/1990 |
| JP | 9169359 | 6/1997 |
| JP | 2001/048298 | 2/2001 |
| JP | 2002/347837 | 12/2002 |
| KR | 930001695 | 3/1993 |
| WO | WO 89/00544 | 1/1989 |
| WO | WO 01/58802 | 8/2001 |
| WO | WO 2005/047171 | 5/2005 |
| WO | WO 2006/096510 | 9/2006 |
| WO | WO 2008/044923 | 4/2008 |

OTHER PUBLICATIONS

U.S. Appl. No. 12/123,262, filed May 19, 2008, Kelly et al.

U.S. Appl. No. 12/128,389, filed May 28, 2008, Kelly et al.

"Bag-in-Box—idea", available at http://www.ankerbrauerei.de/ankerbrauerei/e/dieidee.htm, printed Mar. 26, 2007.

Advertisement: RAPAK, Bag-In-Box Beer, Bag-in-Box innovation for beer, The "Beer Keg" of the future, available at www.rapak.com, Mar. 27, 2007, pp. 2.

Advertisement: Ankerbrau Nordlingen—Genieß' das Ries!, Bag-in-Box-ideas, available at http://www.ankerbrauerei.de/ankerbrauerei/e/dieidee.htm, Mar. 27, 2007, 1 page.

SBG-TAP-A-DRAFT, How It Works, Available at http://www.sturmanbg.com/products/beverage_dispenser.asp, Dated Apr. 15, 2007, p. 1 of 1.

International Search Report for International (PCT) Patent Application No. PCT/US08/86342, mailed Feb. 12, 2009.

Written Opinion for International (PCT) Patent Application No. PCT/US08/86342, mailed Feb. 12, 2009.

International Search Report for International (PCT) Patent Application No. PCT/US09/037385, mailed May 12, 2009.

Written Opinion for International (PCT) Patent Application No. PCT/US09/037385, mailed May 12, 2009.

International Preliminary Report on Patentability for International (PCT) Patent Application No. PCT/US2008/086342, mailed Dec. 2, 2010.

* cited by examiner

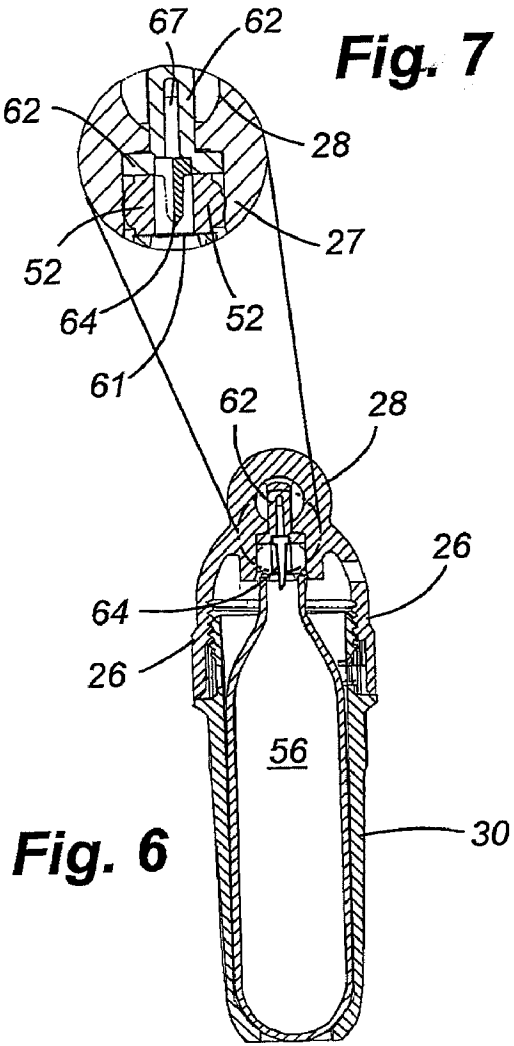
Fig. 7
Fig. 6
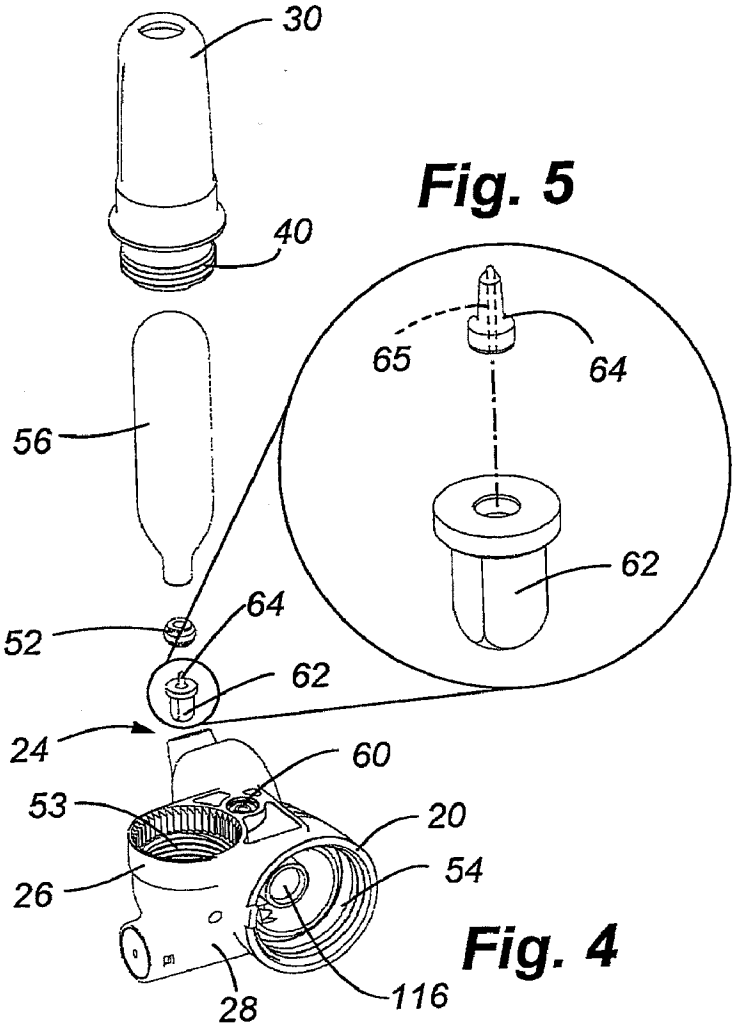
Fig. 5
Fig. 4

16
14
18
120
122
124
115
129
126
128
114
32

22
82
68
115
80
32
68

80
18
32
114
124
34
36
20
38
22
28
30
140
24

REGULATED FLUID DISPENSING DEVICE AND METHOD OF DISPENSING A CARBONATED BEVERAGE

CROSS REFERENCE TO RELATED APPLICATIONS

This application is a continuation-in-part of U.S. patent application Ser. No. 12/123,262, filed May 19, 2008, which is incorporated herein in its entirety by reference.

FIELD OF THE INVENTION

The present invention generally relates to devices used for dispensing beverages, and more particularly, to a fluid dispensing device and method especially adapted for dispensing of carbonated beverages wherein the fluid dispensing device maintains the contents of the beverage container under a regulated pressure.

Many beverages to include soft drinks and malt beverages are sealed in a pressurized container with a gas such as carbon dioxide. Once the container is opened, the pressurized gas within the container escapes thereby causing the beverage to go "flat". It is well known that loss of carbonization adversely affects important qualities of the beverage to include taste, appearance, and other factors. Therefore, there is a need for maintaining the beverage under pressure such that it does not lose its carbonization if the beverage is not immediately consumed.

There are a number of references that disclose fluid dispensing devices capable of maintaining a beverage under a gas-pressurized state.

The U.S. Pat. No. 5,979,713 discloses a tap assembly having a tap, a delivery tube, and a rotatable cam for selectively compressing a resilient flow tube in order to deliver or block flow of fluid therethrough. The dispensed fluid may be pressurized by premixing with another fluid supplied by a manifold. The manifold is adapted to connect to multiple pressurized sources of gas. The tap and manifold have mateable piloting members for easily guiding the components together for snap assembly.

The U.S. Pat. No. 6,036,054 discloses an attachment adapted for a carbonated liquid container. The attachment has a threaded opening that can be directly attached to the threaded opening of the container. A pressurized gas source is provided to maintain the contents of the container under gas pressure. A valve controls the flow of gas into the container. A button actuates the valve. When the button is depressed, the valve is opened and gas flows into the container until the gas pressure overcomes the spring force of the valve, thereby causing the valve to then close. Varying the displacement of the button varies the spring force and the gas pressure within the container.

The U.S. Pat. No. 5,022,565 discloses a portable dispenser that can be connected to a conventional carbonated beverage container to maintain the contents of the container under gas pressure. A tube assembly extends to the bottom of the beverage within the container and has an opposite end that extends through the portable dispenser to a dispenser outlet. A valve mechanism has a spring to selectively open or close the tube assembly, thereby controlling the flow of the beverage therethrough. The dispenser further includes a pressure regulator and a pressurized gas cartridge that provides the source of pressurized gas to the beverage container.

The U.S. Pat. No. 5,443,186 discloses a fluid dispenser that has a button actuated regulator valve and a pressure relief port in the button. The dispenser can be directly attached to the threaded opening of a conventional beverage container. A removable gas cartridge is used to pressurize the contents of the container. The flow of gas into the container is controlled by the regulator valve that is coupled to the button. Pressure within the beverage container can be selectively varied by manually operating the button.

The U.S. Pat. No. 5,395,012 discloses a carbonated soft drink attachment that can be attached to the opening of a container to pressurize the same with a selected gas. The attachment has a housing that holds a removable cartridge that contains the pressurized gas. Extending from the attachment is a button that is connected to a valve that controls the flow of gas into the container. The button and valve are coupled to a spring that functions as a regulator to control the gas pressure within the container. When the button is depressed, the valve is opened and the gas is allowed to flow into the container. The spring maintains the valve in the open position until the gas pressure overcomes the spring force and closes the valve. Varying the position of the button varies the spring force and the gas pressure within the container.

The U.S. Patent Publication No. 2006-0169725 discloses an integrated and disposable dispenser assembly used for maintaining gas pressure within a beverage container. The dispenser may be initially contained within the beverage container, but may then be removed and placed in an operative position to pressurize the contents of the container, thereby avoiding prolonged contact between the contents of the container and the environment. The dispensing force may be controlled by a dispensing valve integrated within the dispenser assembly.

While the foregoing prior art may be adequate for its intended purposes, there is still a need to provide a reliable, efficient and cost effective regulated fluid dispensing device that can be used to maintain the contents of a container under a selected pressure and to allow dispensing of the beverage over time, at the convenience of the user. There is also a need for a fluid dispensing device that is of relatively simple, yet robust construction, and is adapted to attach directly to standard beverage containers. There is also a need to provide a fluid dispensing device that takes advantage of components that can be molded thereby reducing manufacturing costs and simplifying assembly.

Accordingly, the present invention is directed to fulfilling the aforementioned needs and to overcome various disadvantages of the prior art.

SUMMARY OF THE INVENTION

A regulated fluid dispensing device is disclosed that can be used to maintain a beverage under a selected gas pressure while the beverage remains in its container. The fluid dispensing device includes a main housing which holds the basic functional components to include a regulator, a pressure relief mechanism, and a fluid dispensing actuator in the form of a tap handle group. A fluid delivery tube is routed through the fluid dispensing device to deliver the contents of the beverage container to an outlet. The tap handle group controls the flow of the beverage through the fluid delivery tube to either allow flow or to prevent flow through the delivery tube. The regulator is used to set the desired amount of gas pressure that is to be maintained within the container, thereby maintaining the beverage in an optimum carbonated state. The pressure relief mechanism allows gas to escape from the beverage container if an over pressure situation arises that could damage or burst the container.

In the preferred embodiment of the present invention, most of the components may be made from molded thermoplastic material thereby reducing manufacturing costs and simplifying assembly of the device. Pressurized gas is provided to the container by a gas cartridge connected to the fluid dispensing device. The gas cartridge may be, for example, a CO2 gas cartridge that is connected to the housing of the fluid dispensing device.

In another aspect of the present invention, a regulated fluid dispensing system is provided including the dispensing device and a container to hold a quantity of beverage wherein the container is connected to the dispensing device.

In another aspect of the present invention, a method is provided for dispensing a beverage from a pressurized beverage container.

The preferred embodiment of the present invention provides a compact, effective yet relatively simple device that can maintain a selected pressure within a standard beverage container, and allow a user to dispense the beverage over a period of time.

Various other features and advantages of the present invention will become apparent from review of the following detailed description, taken in conjunction with the drawings.

BRIEF DESCRIPTION OF THE DRAWINGS

FIG. 4 is an exploded perspective view of the fluid-dispensing device specifically illustrating the gas cartridge, gas cartridge housing, and selected components of the regulator;

FIG. 5 is a greatly enlarged exploded perspective view of the components of the regulator shown in FIG. 4;

FIG. 6 is a cross-section view illustrating the gas cartridge and gas cartridge housing connected to the housing of the dispensing device;

FIG. 7 is a greatly enlarged cross-section of a portion of FIG. 6 illustrating the piercing needle that is used to pierce the seal on the gas cartridge;

DETAILED DESCRIPTION

Figure 1:
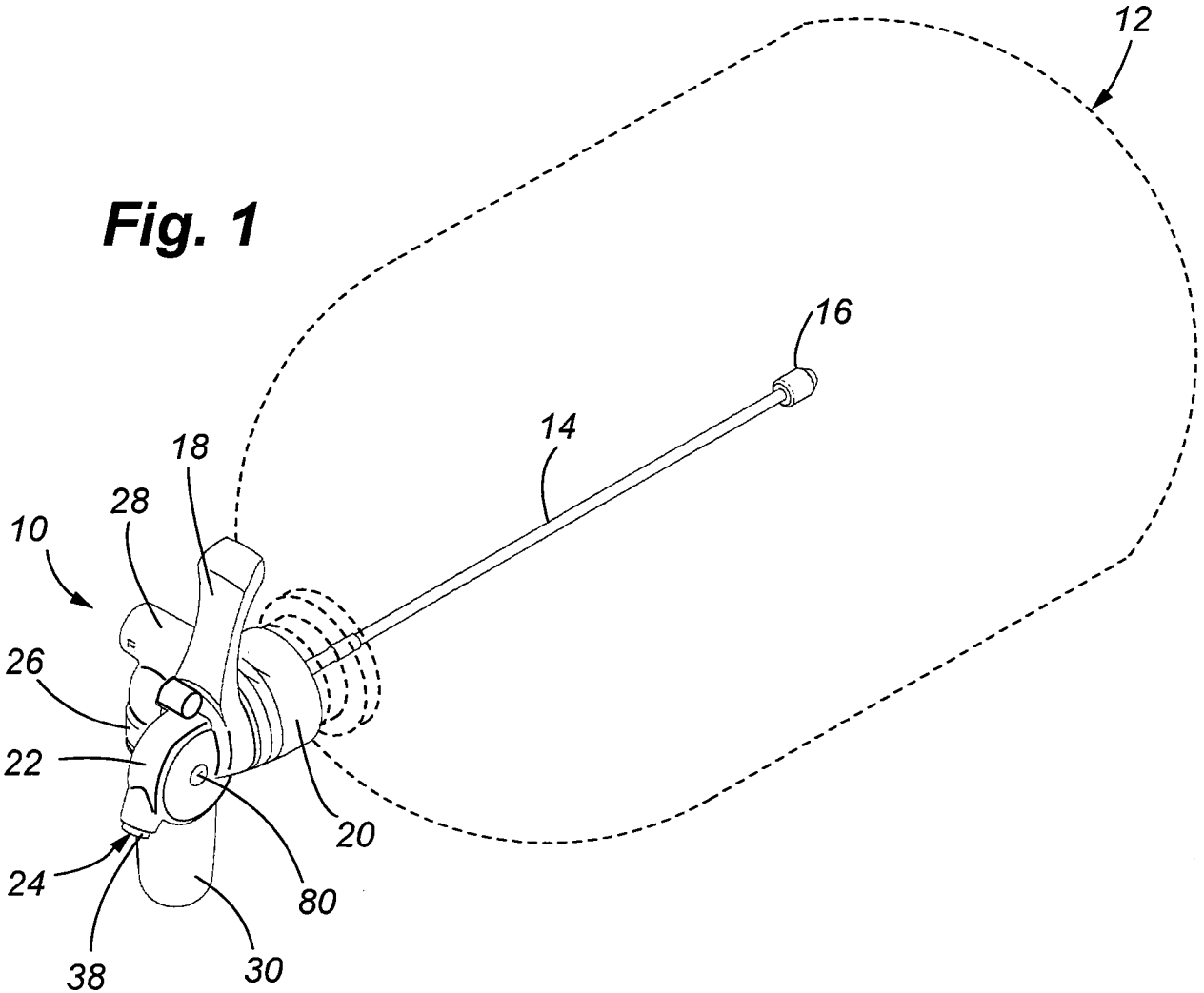
FIG. 1 is a perspective view of a preferred embodiment of the present invention illustrating the regulated fluid-dispensing device attached to a container.
Figure 3:
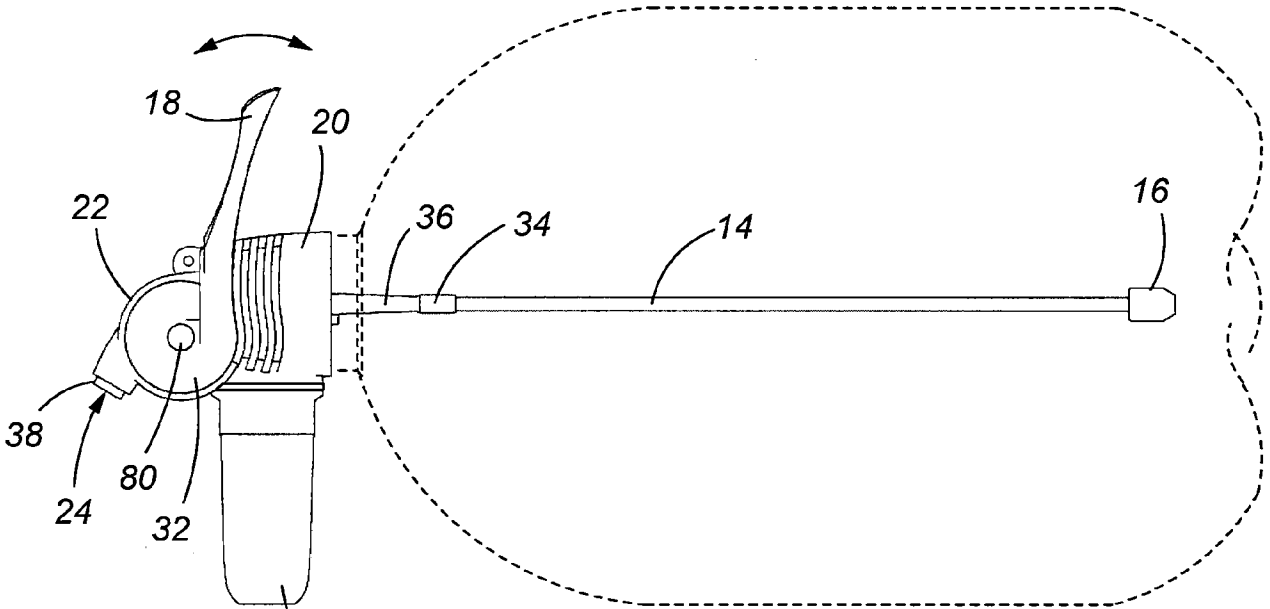
FIG. 3 is a side elevation view of the fluid dispensing device shown connected to the beverage container.
Figure 2A:
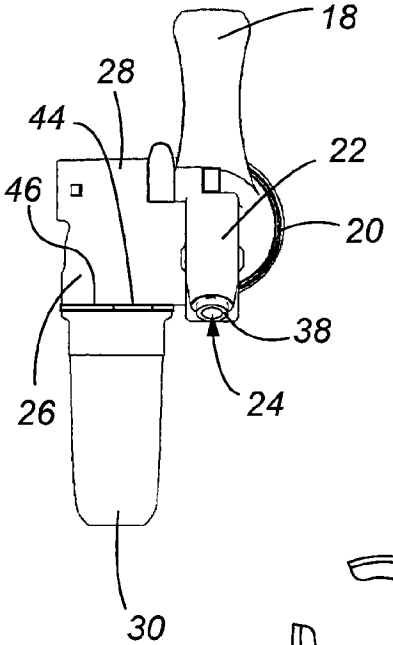
FIG. 2A is a front elevation view of the fluid-dispensing device.
Figure 2B:
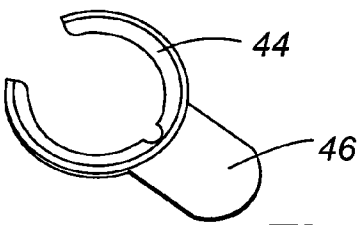
FIG. 2B is a perspective view of a shim that may be used to prevent activation of the gas cartridge when attached to the housing of the fluid dispensing device.
Figure 10:
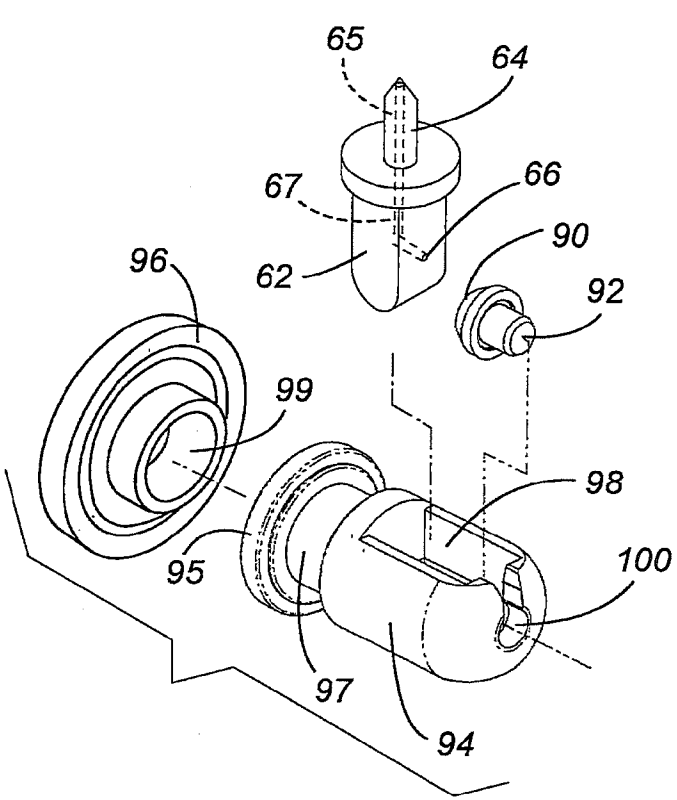
FIG. 10 is an enlarged exploded perspective view illustrating components of the regulator.

Referring to FIGS. 1, 2A and 3, the regulated fluid dispensing device 10 is shown in a preferred embodiment. The external features of the dispensing device are generally characterized as including a tap handle 18 of the tap handle group, a main housing 20, an outlet sub housing 22, a cartridge sub housing 30 that connects to a flange 26, and a regulator sub housing 28. A fluid delivery tube is used to draw the beverage through the dispensing device and to the fluid outlet 24 where the beverage may be transferred to another container for consumption. The fluid delivery tube shown in FIG. 1 includes a main inlet tube portion 14 and a weighted tip 16 secured to a distal end of the inlet tube ensuring that the inlet tube remains near the bottom portion of the beverage container 12. As shown in FIG. 3, the fluid delivery tube further includes an intermediate tube section 36 that connects to the fluid dispensing device, and a fitting 34 interconnects the intermediate tube section 36 and the inlet tube 14. As further explained with respect to FIGS. 17, 18 and 19, the delivery tube further includes a stop flange 37 that interconnects the intermediate tube section 36 to the dispensing/outlet tube 38. The free or distal end of the outlet tube 38 terminates at the fluid outlet 24. Referring specifically to FIG. 2B, a shim 44 is shown. The shim 44 may be placed at the connection between the cartridge housing 30 and the flange 26 of the dispensing device. The shim is used to prevent the cartridge housing from being fully engaged with the flange 26, thereby preventing the piercing needled 64 (See FIG. 5) from piercing the gas cartridge 56, as also further explained below with respect to FIGS. 6 and 7. The shim 44 may include a shim tab 46 that allows the user to remove the shim by pulling on the shim tab, thereby removing it between the cartridge housing 30 and the flange 26.

FIGS. 1 and 3 illustrate the beverage container 12. The specific container illustrated is a 5.7-liter PET bottle. However, it shall be understood that the present invention is not limited to any particular shaped or sized beverage container, and the main housing 20 may be adapted for connection to a number of different types of beverage containers. Referring to FIGS. 4 and 5, the dispensing device is shown with the cartridge housing 30 separated from the dispensing device, along with a gas cartridge 56, such as a CO2 gas cartridge. A threaded opening 54 is provided in the main housing 20 in order to connect the container 12 to the dispensing device. An O-ring seal 55 (FIGS. 8 and 17) may be placed within the opening 54 in order to effectively seal the threaded top of the container with the opening 54.

FIGS. 4 and 5 also illustrate some of the components of the regulator group including the piercing needle base 62, the piercing needle 64, and a sealing gasket 52 that is used to seal the connection between the piercing needle base 62 and the gas cartridge 56. More specifically, referring also to FIGS. 6 and 7, these Figures show the piercing needle base mounted within the fluid dispensing device such that the piercing needle 64 is aligned for contacting the seal 61 of the gas cartridge 56. The cartridge housing 30 is secured to the fluid-dispensing device by engagement of the external threads 40 of the cartridge housing 30 with the internal threads 53 of the dispensing device. In FIG. 7, the piecing needle 64 has not pierced the seal 61, while in FIG. 6, the cartridge housing 30 has been fully screwed onto the main housing of the regulator device such that the dispensing needle is allowed to pierce the seal 61. As shown in FIG. 5, the dispensing needle 64 includes an internal passage 65 that allows the gas to pass from the gas cartridge through the needle 64 and into the piercing needle base 62.

Figure 8:
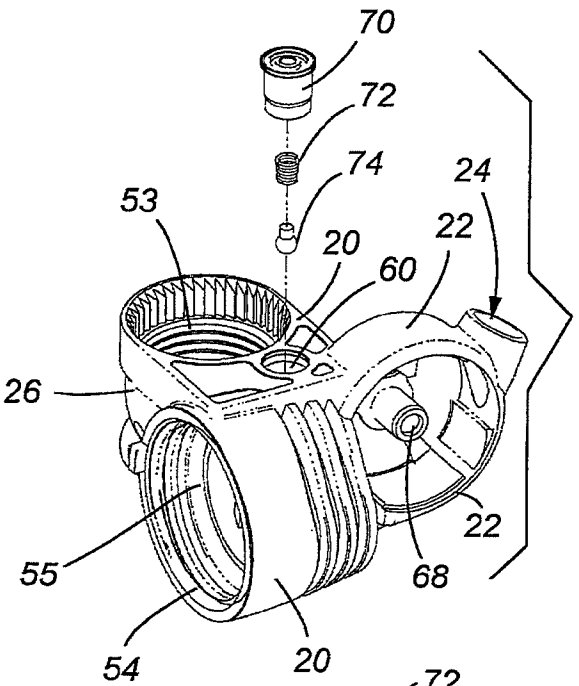
FIG. 8 is another perspective view of the fluid-dispensing device illustrating the tap handle group removed and showing components of the pressure relieve mechanism exploded away from the housing of the fluid dispensing device.
Figure 9:
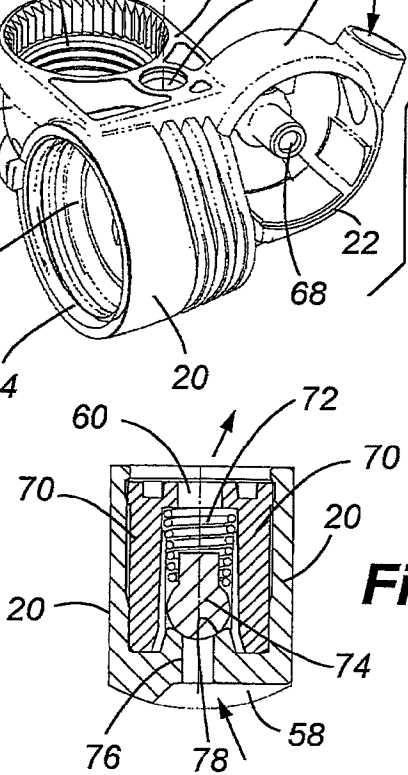
FIG. 9 is an enlarged fragmentary cross-section view showing the pressure relief mechanism mounted to the housing of the fluid dispensing device.
Figure 13:
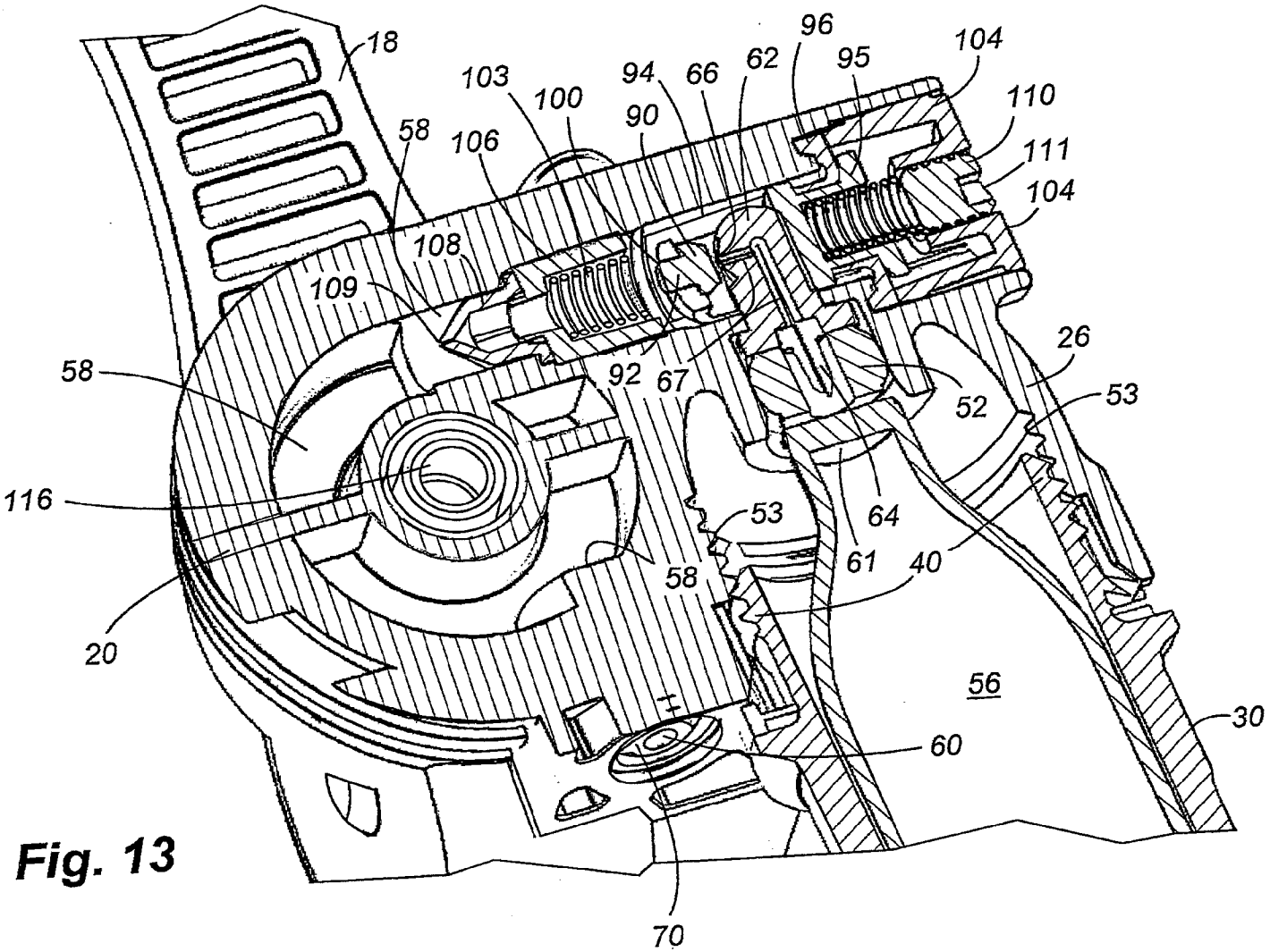
FIG. 13 is a greatly enlarged cross-section illustrating the fluid dispensing device and various components of the device to include the gas cartridge and cartridge housing, and the regulator.

Referring to FIGS. 8, 9 and 13, components of the pressure relief mechanism are shown. The purpose of the pressure relief mechanism is to allow the relief of excess pressure that may build within the container beyond the desired pressure for the particular container and/or beverage that is to be maintained under pressure. Referring to FIG. 8, the pressure relief mechanism includes a pressure relief plug 70 that is placed within a pressure relief opening 60 formed in the housing of the fluid-dispensing device. A pressure relief spring 72 is secured within a central opening of the pressure relief plug. A ball check element 74 is also secured within the central opening of the pressure relief plug, and engages the pressure relief spring 72. A pressure relief passageway 76 communicates with the pressure relief opening 60. A surface 78 defines the seat for the ball check element 74. Referring now also to FIG. 13, the main housing 20 includes an open area 58 that communicates with the pressure relief passageway 76. The open area 58 also communicates with the headspace or open space of the beverage container. As shown by the directional arrows in FIG. 9, if there is an over pressure situation within the container, the over pressured gas will unseat the check ball element 74 from its seat 78, thereby allowing the gas to escape through the central opening of the pressure relief plug and out to the environment through pressure relief opening 60. In order to adjust the relief pressure, the pressure relief spring may be sized to match the desired pressure relief pressure. The check ball element 74 can be made from a resilient material such as rubber such that a good seal is formed when the element 74 is in contact with the seat 78. Alternatively, the check ball element 74 can be made of a stiff, non-resilient material such as stainless steel, and an o-ring (not shown) can be placed between the seat 78 and element 74 such that the o-ring makes the seal.

Figure 11:
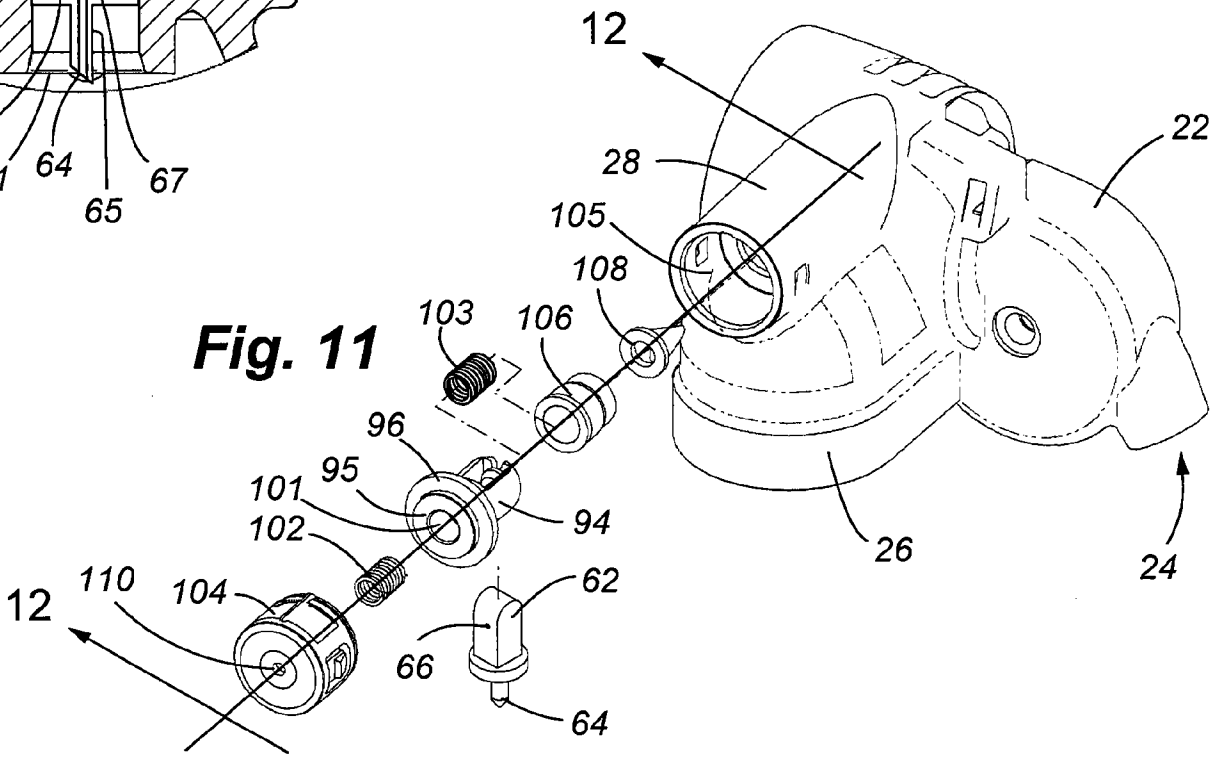
FIG. 11 is an exploded perspective view illustrating the fluid dispensing device and components of the regulator.
Figure 12:
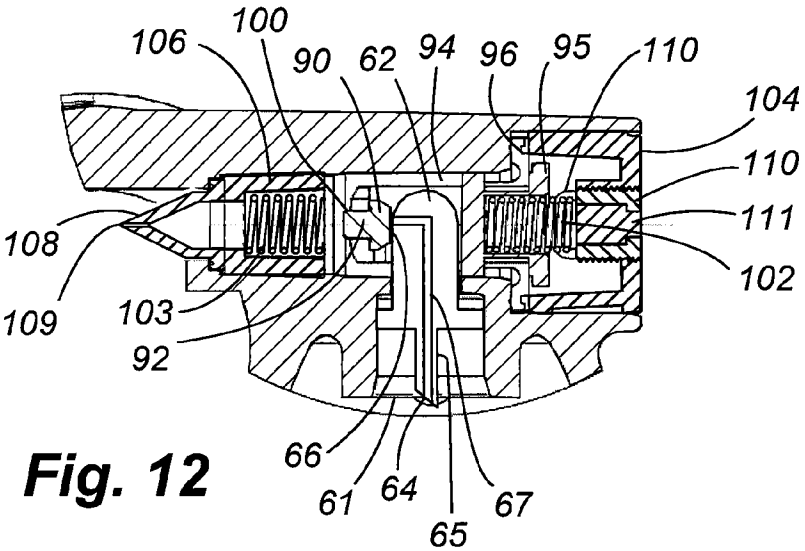
FIG. 12 is an enlarged fragmentary cross-section illustrating the regulator installed in the housing of the fluid dispensing device.

Referring to FIGS. 10-13, the regulator group and its various components are illustrated. Referring first to the piercing needle base 62, the passage 65 in the piercing needle 64 communicates with a passageway 67 formed in the piercing needle base 62. The passageway 67 terminates at an orifice 66 formed on the outer surface of the housing 62. Thus, gas from the gas cartridge passes through passageway 65, passageway 67, and out through orifice 66. A regulator piston 94 engages the piercing needle base 62 by insertion of the housing 62 within opening 98. A regulator-sealing element 90 is also received in the opening 98 such that the element 90 has a surface that contacts the orifice 66. The sealing element 90 is secured within the opening 98 by insertion of the neck portion 92 through end opening 100 in the regulator piston 94. As shown in FIGS. 12 and 13, the regulator seal 90 is aligned such that it makes contact with the orifice 66. The regulator piston 94 further includes a neck 97, and a flange 95. A flexible diaphragm 96 is mounted over the flange 95 and has an opening 99 that receives the neck 97. FIG. 11 shows the diaphragm 96 assembled to the regulator piston 94. The regulator group further includes springs 102 and 103 as shown in FIG. 12. The spring 103 is secured within the central opening or chamber of the regulator plug extension 106. The spring 102 is secured within an opening 101 of the flange 95. The spring 102 is held in place by a regulator cap 104 that is received in an opening 105 of the regulator housing 28. Referring specifically to FIG. 12, the regulator cap 104 has a setscrew 110 that allows the manufacturer to set the spring pressure of the regulator spring 102 by adjusting engagement of the setscrew 110 with the spring 102. For example, the manufacturer will set the desired regulation pressure at the point of assembly to ensure proper specification tolerance to either compress or decompress the regulator spring 102 to a desired degree. The length of the setscrew 110, the pitch of the threads on the setscrew, and the length of threaded area on the setscrew can be adjusted as necessary to provide the precise amount of desired spring pressure to be placed on the regulator piston. The spring 103 provides a counterforce to the force of spring 102 so that the desired regulation pressure may be precisely set. This dual spring action ensures that the regulator piston can index or shift based on the adjustment of spring 102 and the regulator piston does not frictionally engage other components of the regulator that otherwise might inhibit shifting based on adjustment of the spring 102.

The regulator group further includes a regulating plug 108 having an orifice 109 that communicates with the open space 58. The regulator plug extension 106 interconnects the plug 108 with the regulator piston 94. As shown in FIGS. 12 and 13, the internal chambers of plug 108 and extension 106 communicate with the opening 100 that receives the neck portion 92 of sealing element 90.

The operation of the regulator group will now be explained, referring specifically to FIGS. 12 and 13. It is noted in FIG. 13 that the shim 44 has been removed, but the cartridge housing 30 is not fully screwed onto the flange 26, thereby not allowing the piecing needle 64 to pierce the seal 61 of the cartridge. As shown in FIG. 12, when the cartridge housing 30 is fully screwed on, the piercing needle 64 pierces the seal 61. Compressed gas from within the cartridge 56 is then allowed to travel through the passageway 65 of the piercing needle and through the passageway 67 of the needle base 62 to the orifice 66 whereby the gas contacts the sealing element 90. Depending upon the differential forces of the springs 102 and 103, the pressure of the gas at orifice 66 may be great enough to cause the regulator piston 94 to index or shift thereby allowing the compressed gas to escape through orifice 66 and around the sealing element 90. The diaphragm 96 is preferably a flexible, resilient material like rubber such that the regulator piston 94 may freely index in response to the setting of spring 102 and the gas pressure within the gas cylinder. The opening 100 is larger than the diameter of the neck 92, thereby allowing the gas to then proceed into the chamber defined by the interior open space within plug 108 and extension 106. Finally, the gas proceeds through the orifice 109 into the open space 58 that communicates with the headspace of the container. The primary purpose of the plug 108 is to prevent backflow of the beverage into the regulator group and therefore serves as a backflow check valve.

If the pressure within the container and the pressure within the gas cylinder are in equilibrium or if the pressure within the container exceeds pressure within the gas cylinder, then the sealing element 90 will cover the orifice 66, thereby preventing gas from escaping from the gas cylinder. The regulator group provides an effective, compact, and relatively simple structure for regulating the desired amount of pressure within of the container.

Figures 14, 15, 16:
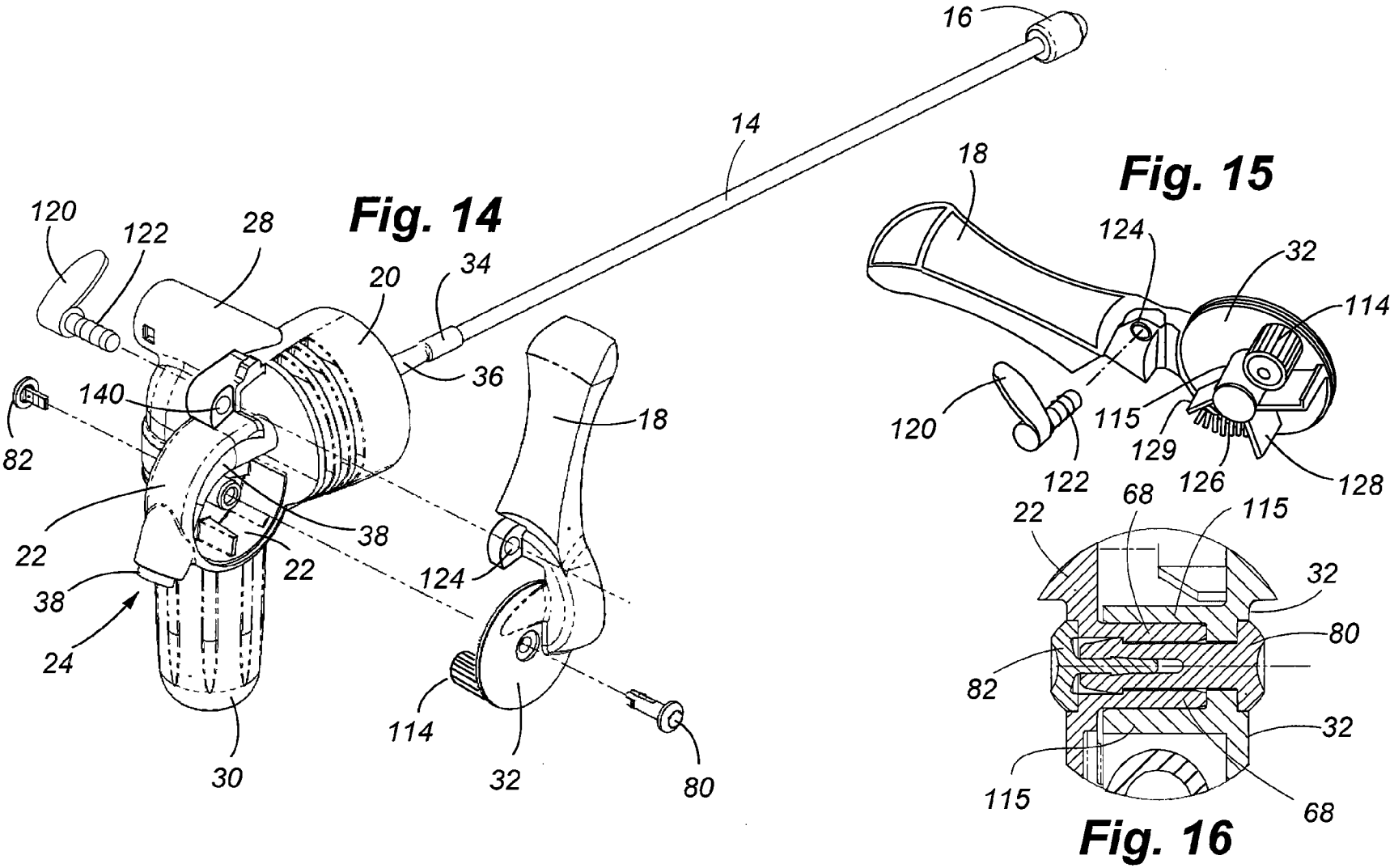
FIG. 14 is another perspective view of the fluid-dispensing device illustrating the tap handle group and locking tab exploded away from the housing of the fluid dispensing device.
FIG. 15 is an enlarged perspective view of the tap handle group and locking tab.
FIG. 16 is an enlarged fragmentary cross-section illustrating the connection of the tap handle group to the fluid dispensing device.

Referring now to FIGS. 14-16, the tap handle group and its components are shown in greater detail. The tap handle group includes a handle 18 secured to a tap handle base 32. As shown in FIG. 15, the tap handle base 32 includes various components such as an extension 115, a spring 126, a spring keeper 128, a tab 129, and an engaging roller 114. The tap handle group is secured to the outlet housing 22 by use of a rivet 80 and rivet cover 82 which are received through the extension 115 of the handle base 32. As shown in FIG. 16, the outlet housing 22 includes a rivet holder extension 68 that slidably engages with the extension 115 of the handle base 32.

Figures 17, 18, 19, 20:
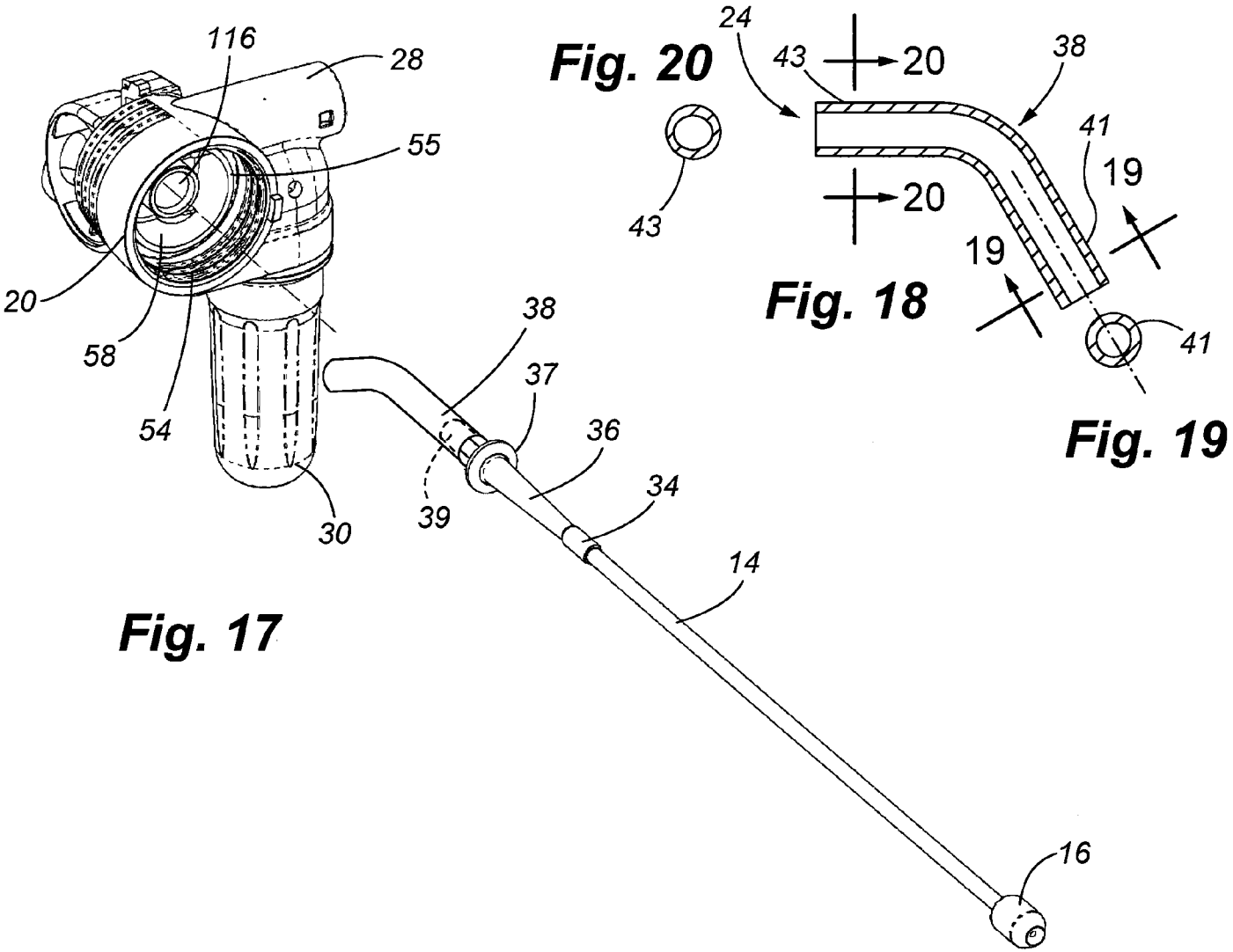
FIG. 17 is another perspective view of the fluid-dispensing device with the fluid delivery tube exploded away from the fluid dispensing device.
FIG. 18 is an enlarged cross-sectional view showing the internal diameter of the passage through the outlet tube wherein the passage transitions from round to oval at the outlet.
FIG. 19 is a cross section taken along line 19-19 of FIG. 18 showing a round cross section.
FIG. 20 is a cross section taken along line 20-20 of FIG. 18 showing an oval cross section at the outlet of the tube.
Figure 21:
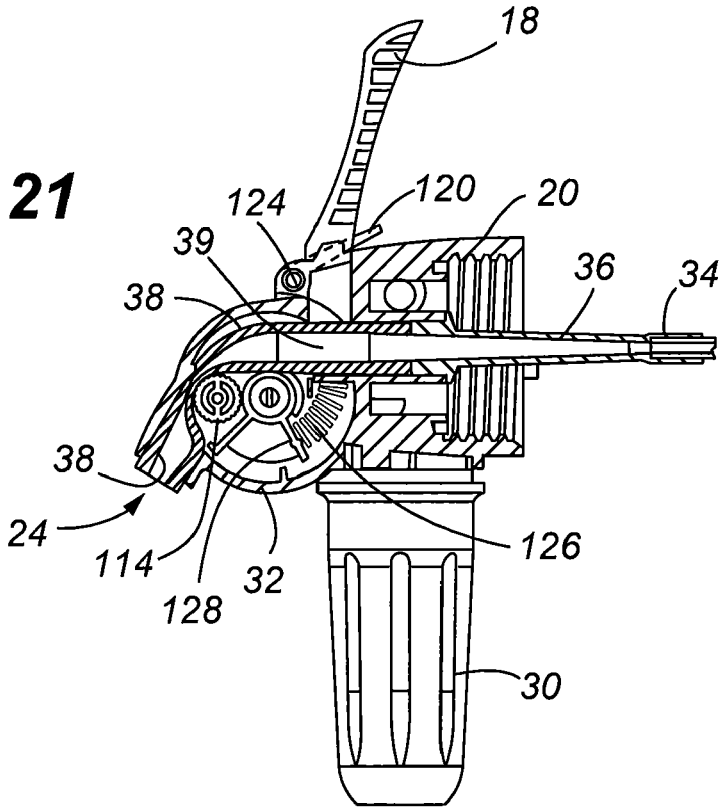
FIG. 21 is a cross-section view illustrating the fluid delivery tube extending through the dispensing device and the tap handle group placed in the closed position to prevent flow through the fluid delivery tube.
Figure 22:
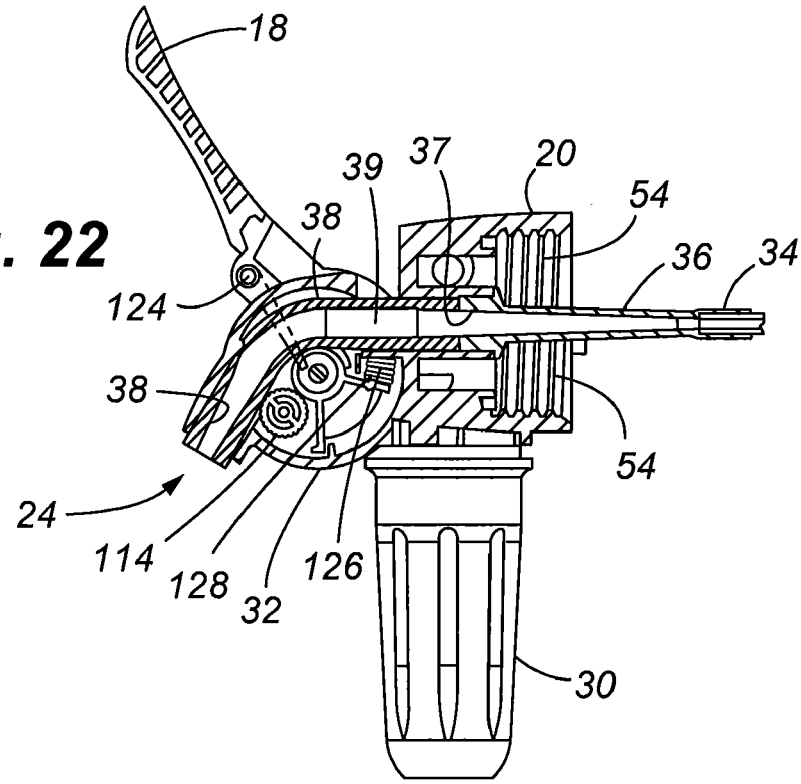
FIG. 22 is another cross-section view illustrating the tap handle group moved to the open position, thereby allowing fluid to flow through the fluid delivery tube.

Referring now to FIGS. 17, 21 and 22, the outlet tube 38 is routed through the passageway 116 of the main housing, and then through the opening within the outlet housing 22 such that the distal end of the outlet tube 38 protrudes at the fluid outlet 24. Preferably, the outlet tube 38 is made of silicone tubing that is very flexible and elastomeric, and will return to its normal cylindrical shape when not engaged by the roller 114. As shown in FIG. 21, the spring 126 is held between the spring keeper 128 and tab 129. The tab 129 abuts the stop flange extension 39, which is used to connect the outlet tube 38 to the stop flange 37. In the closed position of FIG. 21, the engaging roller 114 comes into contact with the outlet tube 38 and compresses the outlet tube such that no liquid is allowed to flow therethrough. When the tap handle 18 is rotated to the open position of FIG. 22, the roller 114 is moved away from the outlet tube 38 therefore allowing it to decompress. It is noted that the roller 114 may be rotatably mounted to the handle base 32 such that the roller 114 makes rolling contact with the tube 38 thereby minimizing potentially damaging scraping of the roller 114 against the tube 38. The resilient, elastomeric integrity of the outlet tube 38 is therefore better maintained over time ensuring that the outlet tube 38 can spring back to its undeformed shape when the tap handle is placed in the open position. As the handle is moved to the open position, the spring 126 compresses. Therefore, the spring 126 is used to help maintain the tap handle in the closed position. It is also noted in FIGS. 21 and 22 that the internal diameter of the passageway of the tube 38 is not uniform and rather, the internal diameter narrows as the tube 38 approached the outlet 24. The increased diameter of the tubing material near the outlet 24 allows the tube 38 to more easily decompress since the thickness of the tubing material increases.

Referring to FIGS. 18-20, it is also contemplated that the shape of the internal passageway of the tube 38 near the outlet 24 can be oval as opposed to round. Referring to FIG. 19, it is seen that the outlet tube 38 has a proximal portion 41 with a conventional round passageway. As the tube 38 extends towards the distal portion 43 at the outlet 24, the internal passageway may transition to an oval shape, as shown in the cross section of FIG. 20. The tube 38 is oriented such that the tube is compressed by the roller 114 along the long axis of the oval passageway. Providing an oval shaped internal passageway facilitates more reliable complete compression of the tube in the closed position, thereby ensuring that the dispensing device does not leak in the closed position.

Referring also now to FIGS. 21 and 22, the tap handle 18 may be rotated between the closed position of FIG. 21 and the open position of FIG. 22. In order to lock the tap handle in the closed position, a locking tab 120 has a threaded portion 122 that is received through a threaded opening 140 formed on the main housing 20. The threaded opening 140 aligns with opening 124 formed on the tap handle 18. In the locked position, the threaded extension 122 extends into the opening 124, thereby preventing rotation of the handle 18. By unscrewing the locking tab 120 thereby removing the extension 122 from the opening 124, the tap handle 18 is allowed to freely rotate between open and closed positions.

Figure 23:
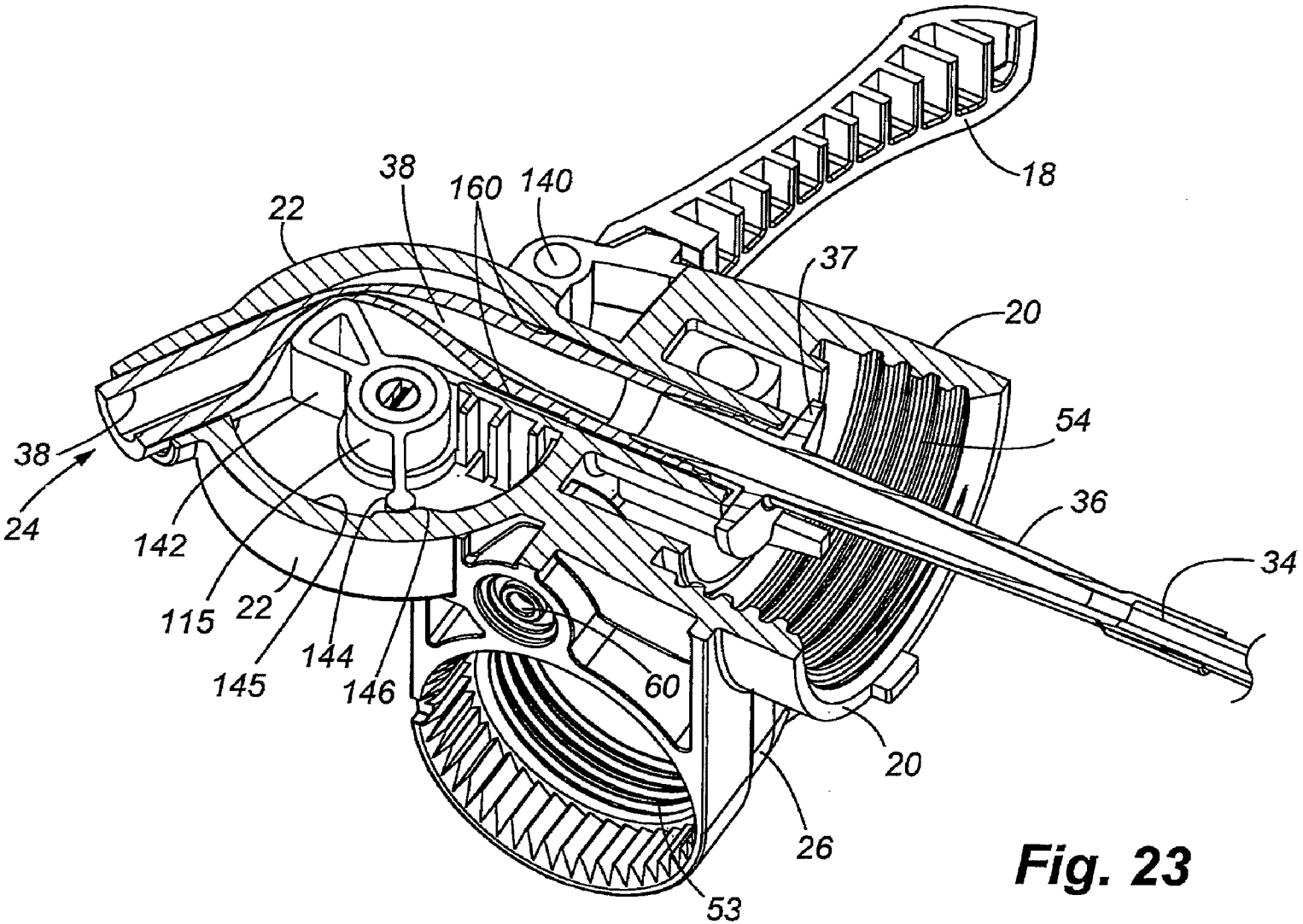
FIG. 23 is another greatly enlarged cross section illustrating the invention in another embodiment specifically showing alternate components that can be used to provide shutoff for the delivery tube, and showing the tap handle moved to the closed position to prevent flow.
Figure 24:
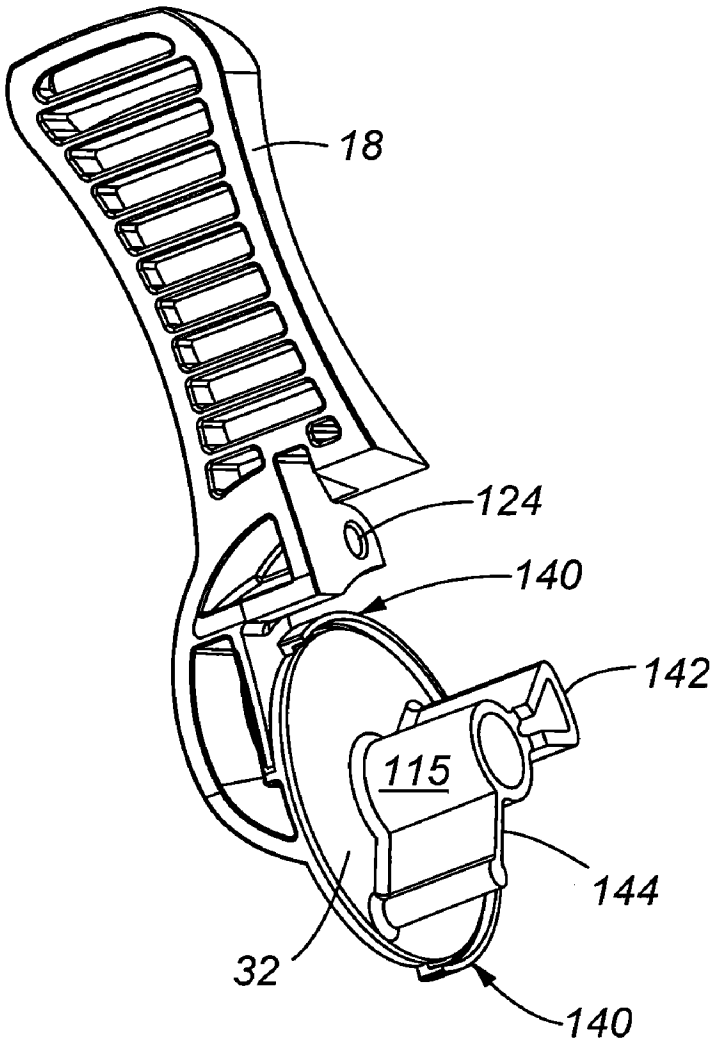
FIG. 24 is a greatly enlarged perspective view of the tap handle group used in the embodiment of FIG. 23.

FIG. 23 illustrates another embodiment of the present invention with alternative tap handle group elements that are used to prevent leakage of fluid through the outlet tube 38 when the tap handle is placed in the closed position. Referring also to FIG. 24, the tap handle group in this embodiment includes a cam 142 that extends radially from the central extension 115 and a stop arm 144 that also extends radially from the central extension 115, and angularly spaced from the cam 142. As shown in FIG. 23, the tap handle has been rotated to the closed position wherein the cam 142 is placed to pinch the outlet tube 38 preventing flow through the tube. The stop arm 144 is centered over the projection 146 that is formed on the internal rim 145 of the sub-housing 22. The free end of the stop arm 144 makes frictional contact with the projection 146 which further assists in maintaining the tap handle in the closed position to overcome pressure within the outlet tube 38 that otherwise has a tendency to force the tap handle to the open position. The projection 146 has a slight curvature or cradle which helps to hold the free end of the stop arm 144 therein. As also shown, the tip of the stop arm is curved or rounded which facilitates it being held frictionally within the curved surface of projection 146. FIG. 23 also illustrates an outlet tube sleeve 160 that is placed over the outlet tube 38 in order to provide additional structural rigidity for the outlet tube 38 upstream of the area where the outlet tube is compressed by the cam 142. Sleeve 160 also helps to better secure the outlet tube 38 within the housing of the device to prevent shifting of the tube that may otherwise occur due to the repeated cycles of opening and closing the tap handle.

Figure 25:
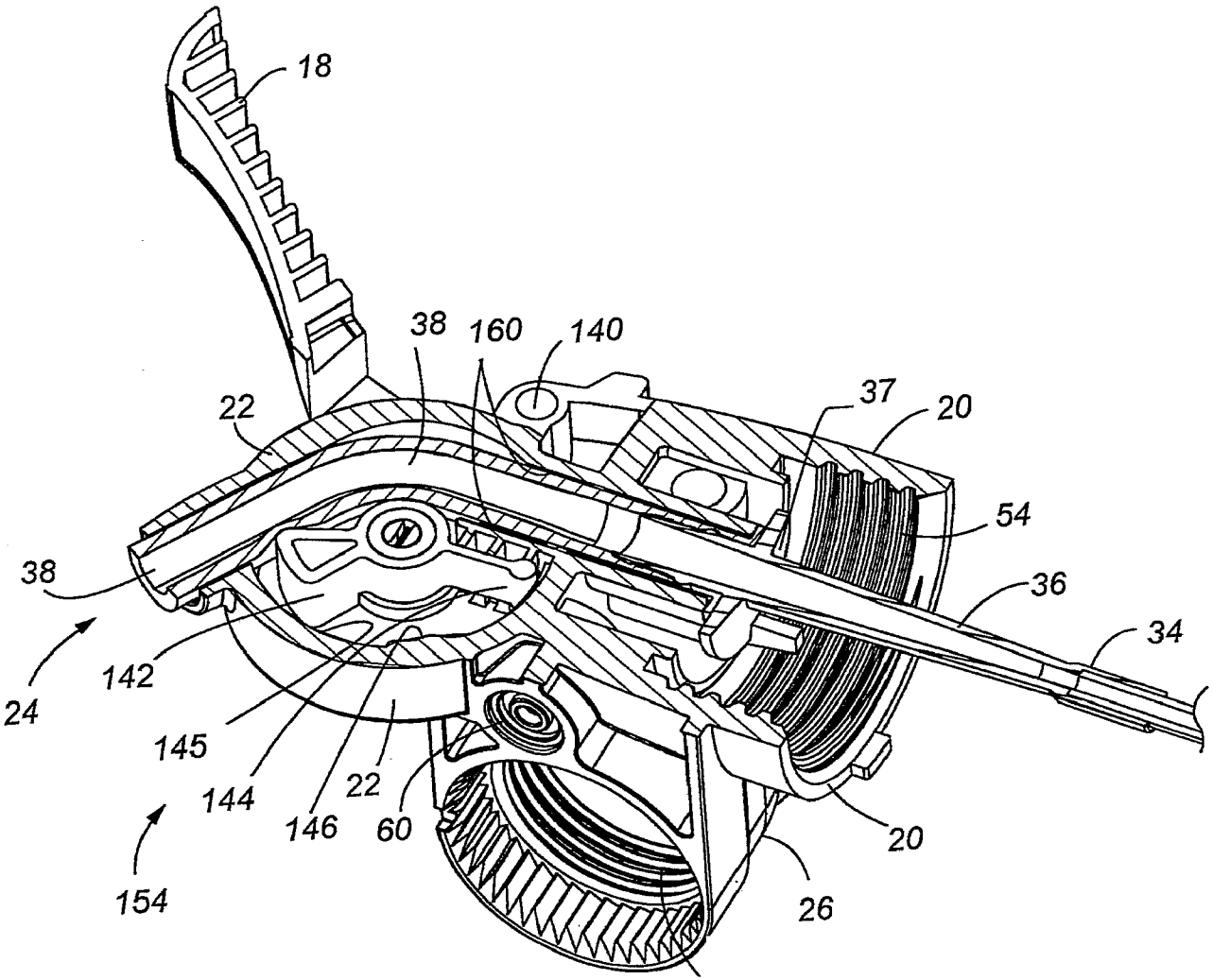
FIG. 25 is another enlarged cross section as shown in FIG. 23 but illustrating the handle moved to the open position.

FIG. 25 illustrates the tap handle moved to the open position wherein the stop arm 144 is unseated from the projection 146, and the cam 142 disengages the outlet tube 38 thereby allowing liquid to flow through the outlet tube 38.

Figures 26, 27:
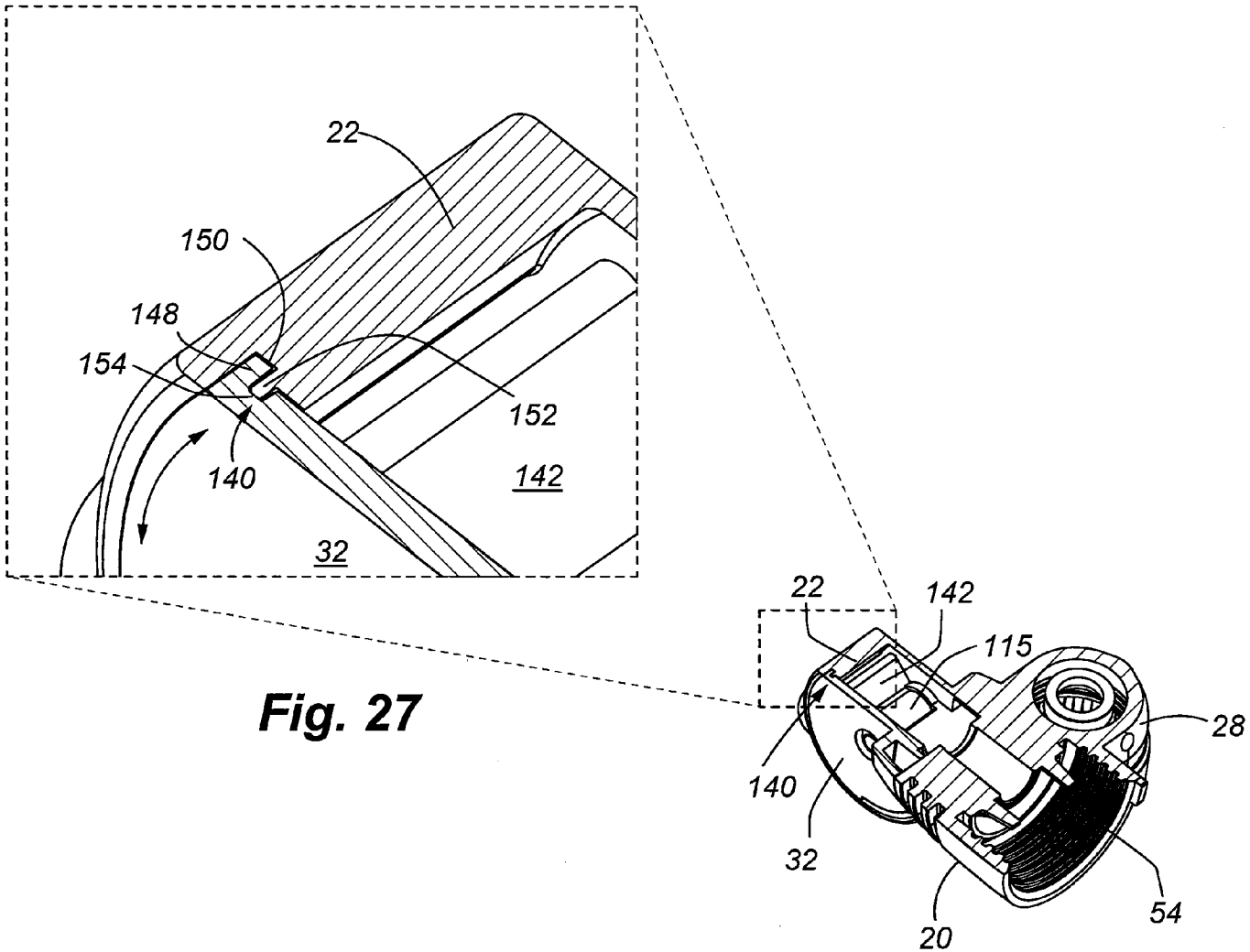
FIG. 26 is a cross section of the fluid dispensing device with various components removed to show a track arrangement incorporated on the connection between the handle and outlet sub-housing to prevent deformation of the elements that can be caused by high temperature and/or high pressure within the outlet tube.
FIG. 27 is a greatly enlarged cross section of the portion identified in FIG. 26 better illustrating the track arrangement.

Referring to FIG. 26, in another embodiment of the present invention, a track arrangement or assembly is provided at the connection between the handle base 32 of the tap handle and the outlet sub-housing 22. This track arrangement provides a more robust connection between the housing and the handle to prevent deformation in the shape of housing and/or handle group caused by environmental factors such as a high temperature or high fluid pressure within the outlet tube that has a tendency to slightly inflate the outlet tube beyond its original dimensions. Referring also to FIG. 27, the track arrangement may also be defined as a double tongue-in-groove assembly characterized by an extension or tongue 148 formed on the periphery of the handle base 32 and an adjacent grove 154. The outlet sub-housing 22 incorporates a complementary extension or tongue 152 that is received in the groove 154, and a groove 150 that receives the tongue 148 from the handle base 32.

Figure 28:
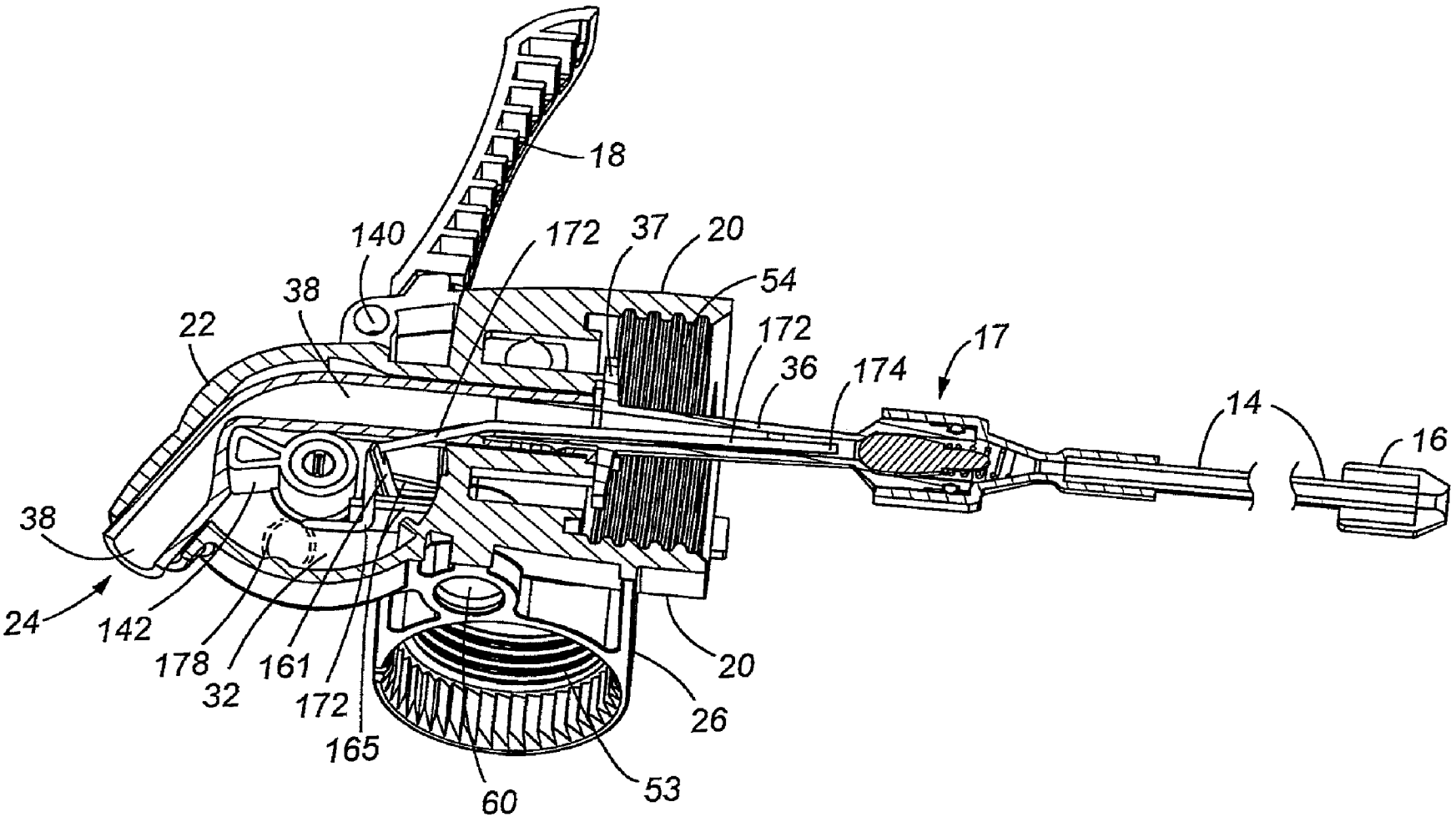
FIG. 28 is an enlarged cross section illustrating another embodiment of the present invention that incorporates a diffuser assembly for control of the dispensing device between the open and closed positions.
Figure 29:
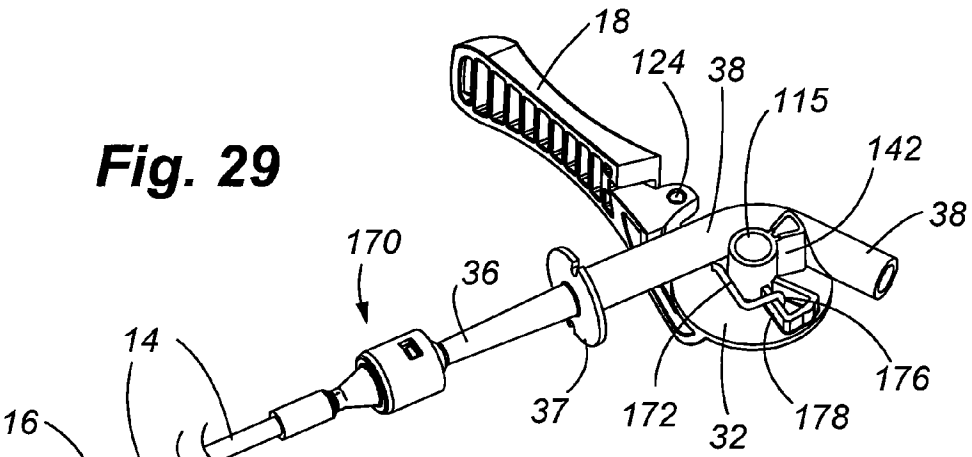
FIG. 29 is a perspective view of the tap handle group illustrating a trap element used to secure a transfer rod to the top handle group.
Figure 30:
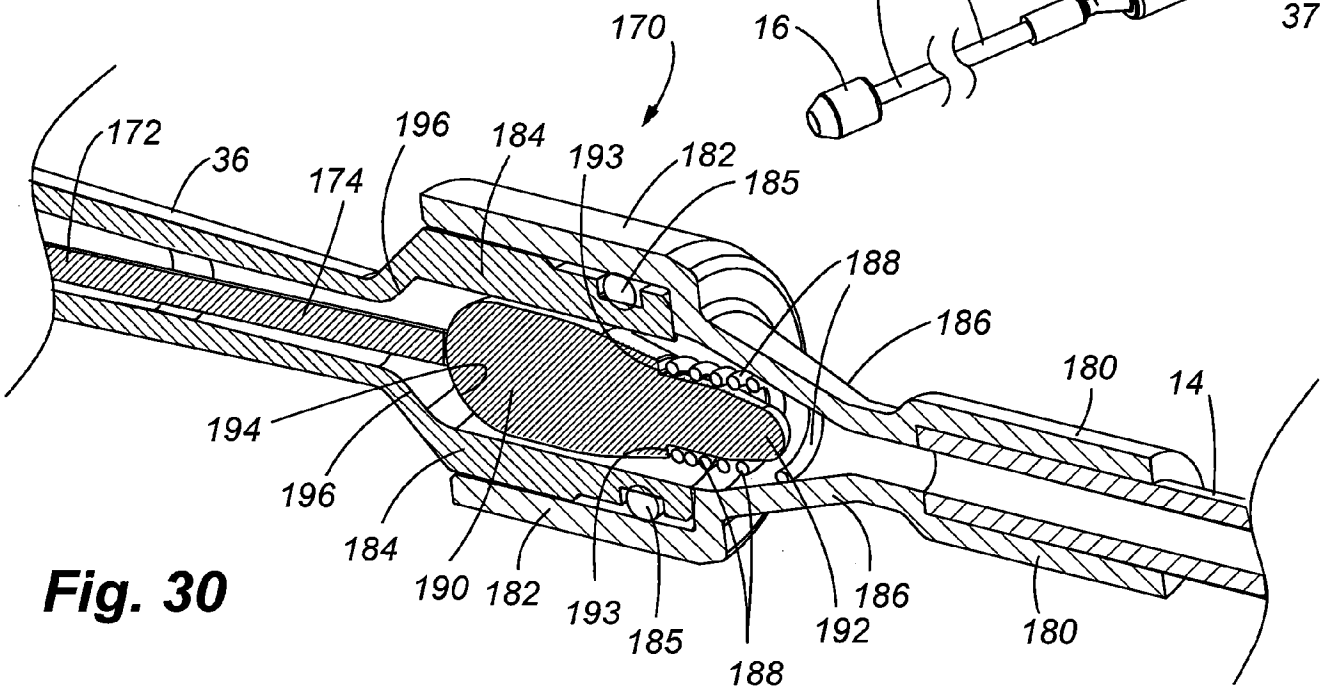
FIG. 30 is a greatly enlarged cross section illustrating components of the diffuser assembly when the handle is moved to the open position causing a transfer rod to engage a check element resulting in the check element being removed from contact with a valve seat to allow flow around the check element and through the outlet tube.

Referring to FIGS. 28-30, in another embodiment of the present invention, a diffuser assembly 170 is provided as an alternate means to provide shutoff control for fluid through the dispensing/outlet tube. The diffuser assembly incorporates a transfer rod 172 that is actuated by movement of the handle 18 to stop or allow flow through the outlet tube 38. The actuating end 174 for the rod 172 contacts a check element 190 and unseats the check from seat 196 as discussed further below with reference to FIG. 31. The opposite or fixed end 176 of the transfer rod 172 is extends through an opening in the handle base 32 formed adjacent the central extension 115. This opposite ends therefore resides on the opposite side of the handle base and is secured to trap 178 formed on that side of the handle base 32.

Figure 31:
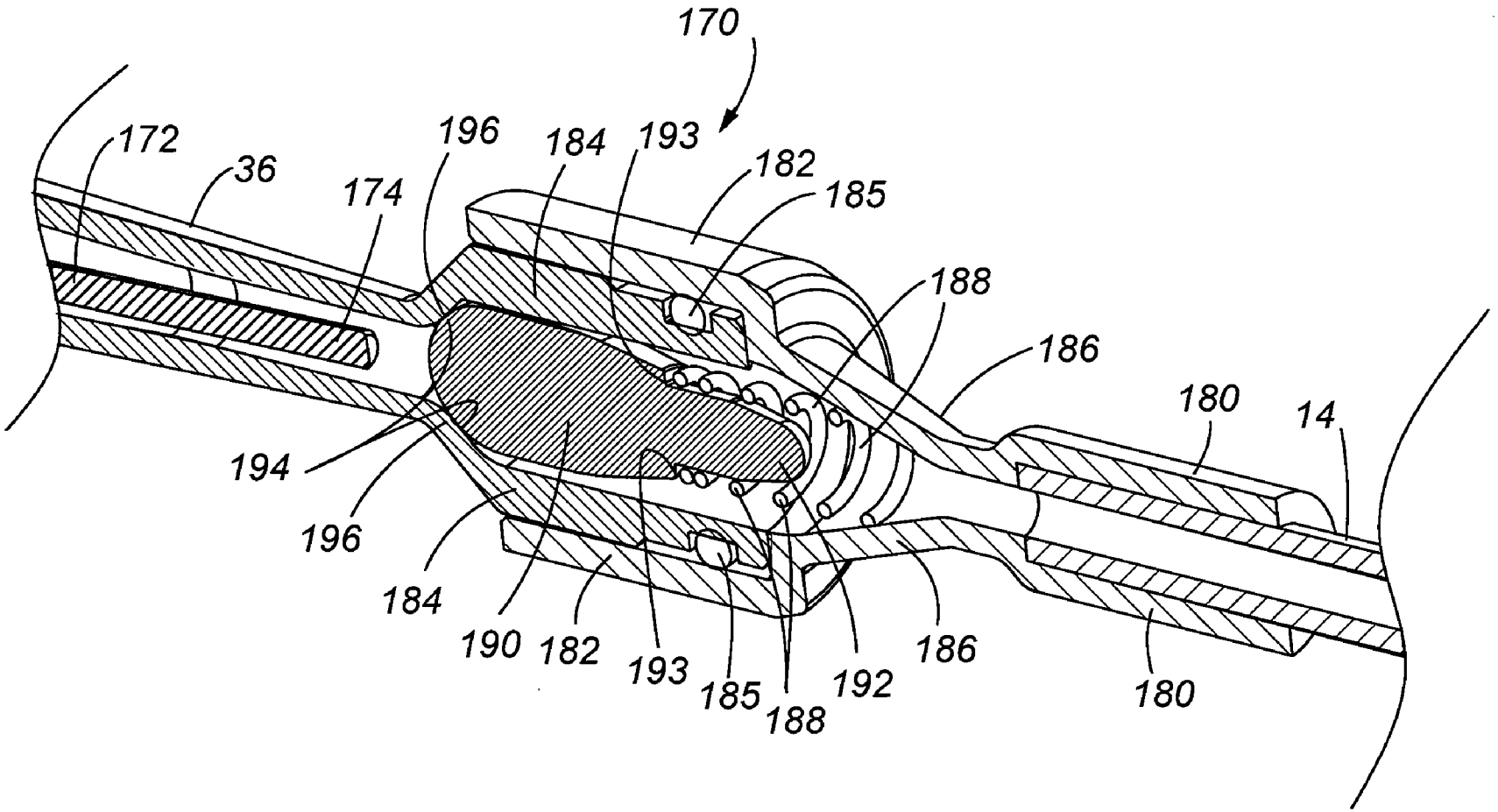
FIG. 31 is a greatly enlarged cross section illustrating components of the diffuser assembly when the handle is moved to the closed position causing the transfer rod to disengage the check element resulting in the check element making contact with the seat to block flow through the outlet tube.

Referring to FIG. 31, the components of the diffuser assembly 170 include an outer housing 182 and an inner housing 184 sealed to one another by sealing gasket 185. A chamber or open space within the inner housing 184 receives the check element or "torpedo" 190 with a curved head portion 194 that sealingly engages valve seat 196. The check 190 is urged to its seated position by a spring 188 that attaches to the tail portion 192 of the check element 190. A shoulder 193 limits one end of the spring, and the opposite end of the spring is limited by the narrowing neck portion 186. The inlet tube 14 attaches to the diffuser assembly 170 by inserting it through the receiver 180 that communicates with the chamber within the inner housing 184. When the tap handle is in the closed position, the actuating end 174 of the rod 172 does not make contact with the head portion 194 of the check 190 as shown in FIG. 28. Referring to FIG. 30, when the handle 18 is rotated to the open position, the transfer rod is displaced through the intermediate tube section 36 and the actuating end 174 contacts the head portion 194 to unseat the check 190 from the valve seat 196. Liquid is then allowed to flow concentrically around the check 190 and into the intermediate tube section 36 to the outlet/dispensing tube 38. Referring back to FIG. 28, the handle 18 is biased to a normally closed position by the use of leaf spring 161 that contacts the transfer rod 172. The leaf spring has a v-shape with a base leg (not shown), that is captured in the gap or channel between rails 165 that are formed on one side of the handle base 32. The exposed leg of the leaf spring is shown and makes contact with the transfer rod 172. The leaf spring 161 is preferably positioned so that it places continual pressure on the transfer rod 172 throughout all rotational positions of the tap handle thereby urging the tap handle to the closed position.

Figure 32:
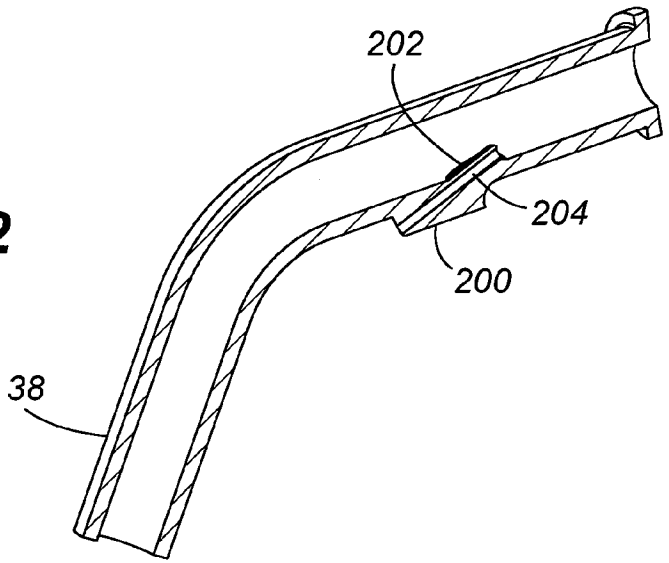
FIG. 32 is a greatly enlarged cross section of the delivery tube illustrating its construction when incorporating the transfer rod in which a passageway is formed through the tube to receive the transfer rod.
Figure 33:
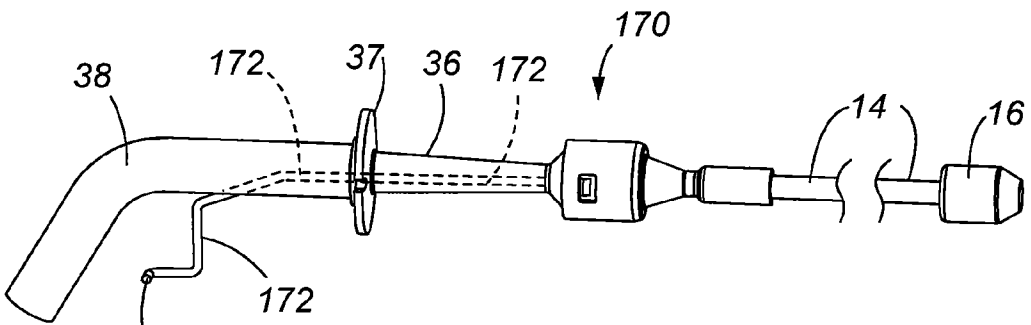
FIG. 33 is an enlarged perspective view of the delivery path for the fluid including the fluid delivery tube, diffuser assembly, and transfer rod.

Referring to FIGS. 32 and 33, the arrangement of the transfer rod 172 is shown with respect to how the transfer rod enters the outlet tube 38 for its extension through the intermediate tube to the diffuser assembly 170. The transfer rod 172 enters the outlet tube 38 through a passageway 204 having a diameter that is slightly smaller than the diameter of the transfer rod. A thickened area or flange 200 is formed on the exterior of the tube 38, along with an interior thickened area 202 that provides additional structural support for the rod to move within the tube without damaging or displacing the tube. The passageway 204 provides an effective seal for preventing liquid from escaping the outlet tube 38. The transfer rod 172 is able to effectively move back and forth within the passageway 204 without fluid leakage due to the resilient elastomeric nature of the outlet tube material. It is also noted in FIGS. 28 and 29 that the cam 142 has not been eliminated, thus the cam 142 also provides a secondary or backup closure means to prevent fluid flow through the outlet tube when the handle is placed in a closed position. The cam 142 in this embodiment also helps to prevent prolonged dripping of fluid from the outlet tube. Since the flow of fluid is shutoff upstream, there will be an amount of fluid already in the intermediate tube 36 and outlet tube 38. Thus, the cam 142 thereby serves dual purposes in this embodiment. Although not shown, this embodiment could also utilize the stop arm 144 to help maintain the handle in the closed position.

One advantage to using the diffuser assembly 170 is that the smooth, fluid dynamic shaped check 190 allows a very smooth flow of fluid around the check to prevent turbulent flow which otherwise contributes to excessive nucleation/foam in carbonated beverages. As the check 190 is unseated, the volume of fluid through the diffuser assembly steadily increases until there is a full flow of fluid in a stream that is not subject to sharp turns or blockages which might otherwise contribute to turbulence.

There are numerous advantages to the present invention. A compact yet structurally sound dispensing device is provided that allows a user to selectively dispense a beverage attached to the dispensing device. Pressure can be regulated within the beverage container, and a pressure release mechanism prevents over-pressurization of the container. The gas cartridge supplying the compressed source of gas is conveniently mounted to the dispenser at a location that does not interfere with the user's actuation of the tap handle. The location of the cartridge allows the dispensing device to be positioned so that the beverage container can be placed on its side allowing the container to be conveniently mounted on a horizontal shelf space.

In accordance with another aspect of the invention, a method is provided for dispensing a beverage from a dispensing device having an integral source of compressed gas to maintain the beverage container at a desired pressure. In accordance with the method, a fluid delivery tube extends through a housing of the dispensing device, and dispensing of the beverage is controlled by actuation of a tap handle between an open and closed position. In the closed position, a roller contacts the delivery tube and pinches or squeezes the tube so that fluid cannot flow therethrough. In the open position, the tap handle is rotated such that the roller disengages from the fluid delivery tube thereby allowing it to decompress and therefore allowing fluid to flow through the delivery tube. In another method, in lieu of pinching or compressing the tube, a diffuser assembly is placed in the line with the fluid path and a transfer rod connected to the tap handle group controls a check valve arrangement in the diffuser to shut off or allow flow of the beverage. A regulator enables a user to selectively set a pressure to be maintained within the beverage container. An integral pressure relief device also automatically accounts for over pressurization of the container allowing gas to escape from the container.

Although the present invention has been described above with respect to various preferred embodiments, various changes and modifications can be made to the invention commensurate with the scope of the claims appended hereto.

What is claimed:

1. A regulated fluid dispensing device especially adapted for dispensing carbonated beverages, said dispensing device comprising:

a main housing having a cavity, and a fluid regulator mounted therein;

a pressure relief mechanism incorporated in said main housing;

a source of compressed gas for supplying a flow of gas through said regulator into a beverage container attached to said dispensing device;

a tap handle operatively connected to said main housing for selectively allowing the beverage to flow through said dispensing device, said tap handle having a cam and a stop arm attached to a base portion of said tap handle;

said main housing further including an outlet sub-housing surrounding said base of said tap handle, said outlet sub-housing having an interior rim and a projection formed on said rim; and a fluid delivery tube extending through said dispensing device for delivering the beverage, said cam of said tap handle selectively engaging and disengaging said fluid delivery tube to allow beverage to flow therethrough, or to shut off flow of beverage through said fluid delivery tube, and wherein said stop arm of said tap handle frictionally engages said projection when said tap handle is placed in a closed position to shut off the flow of beverage through said delivery tube.

2. A device, as claimed in claim 1, further including:

a sleeve for providing structural support to said fluid delivery tube, said fluid delivery tube extending through said sleeve and said sleeve being located within said main housing.

3. A method of dispensing a beverage from a pressurized beverage container, said method comprising:

providing a dispensing device secured to the beverage container, said device including an integral regulator and an integral pressure release mechanism, said device further including a fluid delivery tube extending through the device and communicating with the beverage container for conveying the beverage for dispensing, a source of pressurized gas communicating with the regulator for maintaining the beverage container at a desired pressure, a tap handle rotatably connected to the dispensing device, said tap handle, including a cam and a stop arm;

positioning the tap handle in a closed position such that the cam makes contact with said fluid delivery tube to prevent the beverage from flowing therethrough, and wherein the stop arm contacts a projection formed in the housing to maintain frictional resistance to maintain said tap handle in the closed position;

rotating the tap handle from the closed position to an open position wherein the cam is rotated away from contact with the fluid delivery tube thereby allowing the beverage to flow through the delivery tube to thereby dispense the beverage through an outlet defined by a distal end of the fluid delivery tube, and wherein the stop arm is disengaged from the projection.

* * * * *